United States Patent [19]

Yamamoto

[11] Patent Number: 4,760,768

[45] Date of Patent: Aug. 2, 1988

[54] MECHANISM FOR SUPPRESSING BOUND OF SWINGABLE ELEMENTS ON A KEY MUSICAL INSTRUMENT

[75] Inventor: Jun Yamamoto, Hamamatsu, Japan

[73] Assignee: Nippon Gakki Seizo Kabushiki Kaisha, Japan

[21] Appl. No.: 793,627

[22] Filed: Oct. 31, 1985

[30] Foreign Application Priority Data

Nov. 9, 1984 [JP] Japan ..... 59-169180
Nov. 9, 1984 [JP] Japan ..... 59-169181
Apr. 12, 1985 [JP] Japan ..... 60-76596

[51] Int. Cl.[4] ..... G10C 3/18

[52] U.S. Cl. ..... 84/236; 84/440; 267/124

[58] Field of Search ..... 84/236, 243, 244, 253, 84/254, 255, 439, 440, DIG. 7; 188/266; 267/116, 124, 121, 139

[56] References Cited

U.S. PATENT DOCUMENTS 3,175,451 3/1965 Klann ..... 84/439 X
3,899,952 8/1975 Regan ..... 84/236
4,121,490 10/1978 Deutsch ..... 84/DIG. 7
4,152,967 5/1979 Barron ..... 84/440 X

FOREIGN PATENT DOCUMENTS 0588422 1/1978 U.S.S.R. ..... 188/266
1188393 10/1985 U.S.S.R. ..... 267/139

*Primary Examiner*—Michael L. Gellner
*Assistant Examiner*—Brian W. Brown
*Attorney, Agent, or Firm*—Lerner, David, Littenberg, Krumholz & Mentlik

[57] ABSTRACT

In construction of a key musical instrument such as a piano, a swingable element such as a hammer is accompanied with a pneumatic damper having an air vent so that, when impulsive load is applied by motion of the swingable element, fluid viscous resistance caused by flow of air in the pneumatic damper well absorbs shock, thereby greatly suppressing undesirable bound of said swingable element on return to its initial rest position.

12 Claims, 6 Drawing Sheets

MECHANISM FOR SUPPRESSING BOUND OF SWINGABLE ELEMENTS ON A KEY MUSICAL INSTRUMENT

BACKGROUND OF THE INVENTION

The present invention relates to an improved mechanism for suppressing bound of swingable elements on a key musical instrument, and more particularly relates to an improvement in a mechanism for suppressing bound of swingable elements such as keys and hammers on a piano.

A piano includes lots of swingable elements each of which swings, on key depression, about a given pivot and returns, on removal of the key depression, to its initial rest position at which a shock absorvable seat is usually provided in order to minimize undesirable bound of the swingable element.

A hammer of a piano is one example.

In construction of a hammer assembly, a hammer is pivoted via a butt to a butt flange and usually rests at an initial position on a hammer rail cloth attached to a hammer rail. When an associated key is depressed, the hammer swings upwards about the butt flange in order to beat a corresponding string. After beating the string, the hammer returns towards its initial rest position on the hammer rail cloth due to repulsion of the string. The quicker the returning motion, the larger the bound of the hammer on arrival at the hammer rail cloth and the hammer cannot swiftly assume its initial rest position on the hammer rail cloth. In other words, such bound on the hammer rail cloth causes belated settlement of the hammer to its initial rest position. When a same key is separatedly depressed at quick tempo during performance, such belated settlement to the initial rest position disenables correct transmission of key motion to the hammer and, as a consequence, string beating cannot be carried out as intended by the player.

A hammer assembly is closely related in motion to an associated key assembly and a hammer hits a jack. Shock caused by this hit is transmitted to the associated key via a wippen and a capstan. During swing motion of the hammer, the key is in a free state with respect to the action assembly. When the shock is transmitted, the key in this free state tends to bound.

Further, bound of a hammer causes vibration of the hammer which seriously delays return motion of the action assembly to its initial rest position, thereby posing ill influence on key touch. Delay in return motion of the action assembly naturally causes corresponding delay in motion of the damper assembly which results in ill damping motion. From these points of view, quick settlement of the initial position by a hammer plays a very important role in performance of a piano. In addition, since a hammer usually has large dynamic energy, its uncontrolled motion tends to cause irregular vibration of related assemblies.

It is already proposed, for example in Japanese Patent Opening Nos. Sho 52-96522 and Sho 58-186797, to arrange a mechanism for absorving dynamic energy of a hammer when it returns towards the initial rest position. Such prior mechanisms, however, are all based on use of a spring or springs which cannot full suppress bound of a hammer at arrival at the initial rest position. When a hammer hits such a mechanism, a spring may once absorve the shock by its elastic deformation. Soon after, however, elastic recovery of the spring acts to push back the hammer. The stronger the shock, the larger the elastic recovery. So, when an associated key is depressed strongly, the elastic recovery causes delay in settlement to the initial rest position by the hammer.

A key of a piano is another example. In construction of a key board assembly, a key is pivoted at its middle to a balance rail and its rear end usually rests at an initial rest position on a back rail cloth attached to a back rail. When the key is depressed, its rear end swings upwards about the balance rail in order to toss up an associated wippen assembly. On removal of depression on the key, its rear end returns towards its initial rest position on the back rail cloth which more or less alleviates shock and noise caused by return of the key end. The softer the back rail cloth, the greater the alleviation. Too soft construction of the back rail cloth, however, is too susceptible to change in environmental conditions and, as a consequence, easy change in dimension. Such change in dimension causes uneven mobil ambit of the key. In order to obviate such a trouble, the back rail cloth is required to have some extent of hardness which disenables ideal absorption of shock and noise when hit by the key end. As a consequence, the key bounds when its rear end hits the back rail cloth and such bound of the key inevitably transmits noize and vibration to the key bed, thereby degrading performance. Such bound also transmit vibration to player's fingers and causes ill influence on key touch, poor damping and difficulty in quickly repeated depression of a same key in performance.

In order to avoid this inconveniency. Japanese Utility Model Publication No. Sho 59-24076 proposes to use felt or the like for absorption shock by the key end. But the materials proposed by this prior proposal are all vulnerable to change in environmental conditions and allow easy change in dimension of the back rail cloth. No constant mobile ambit of the key is assured.

SUMMARY OF THE INVENTION

It is the object of the present invention to effectively suppress bound of swingable elements on a key musical instrument while avoiding any ill influence of change in environmental conditions.

In accordance with the present invention, a pneumatic damper is arranged at a location on a key musical instrument where a swingable element assumes its initial rest position.

DESCRIPTION OF THE PREFERRED EMBODIMENT

Figure 1:
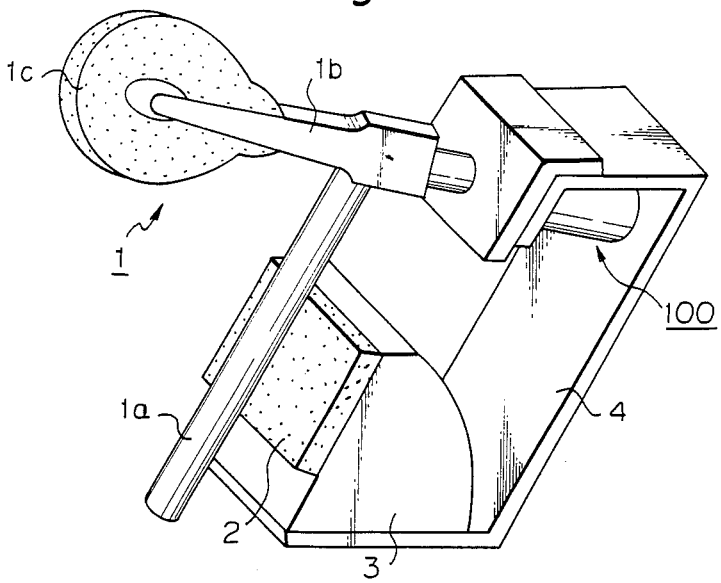
FIG. 1 is a fragmentary perspective view of an action assembly of an upright piano provided with one embodiment of the bound suppressing mechanism in accordance with the present invention.

In the embodiment shown in FIG. 1, the present invention is applied to an action assembly for an upright piano. The action assembly includes a hammer 1 which is made up of a hammer shank 1*a* coupled at its lower end to a butt (not shown), a hammer wood 1*b* mounted atop to the hammer shank 1*a* and a hammer felt is coupled to the front end of the hammer wood 1*b*. In the drawing, the hammer 1 is at its initial rest position with the hammer shank 1*a* in contact with an under rail cloth 2 on a hammer rail 3. On key depression, the hammer 1 swings upwards off the hammer rail cloth 2 in order beat an overhead string (not shown). The hammer rail 3 has a rear extension 4 which extends upwards in order to carry a pneumatic damper 100 in accordance with the present invention.

Figure 2:
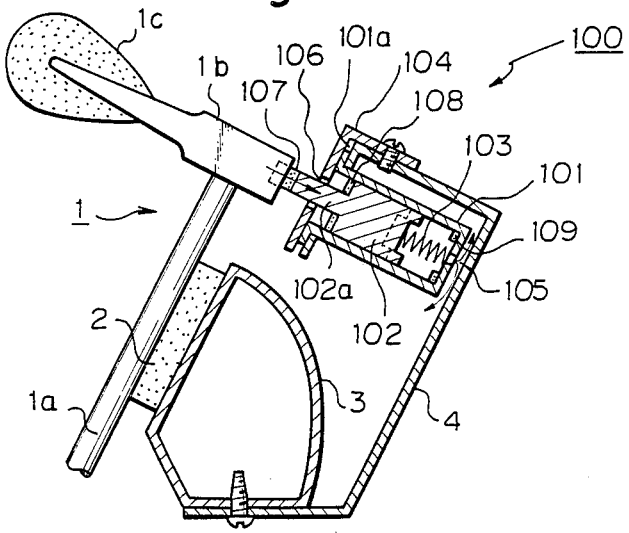
FIG. 2 is a side sectional view of the bound suppressing mechanism shown in FIG. 1, FIGS. 3A to 3B are side sectional views of other embodiments of the bound suppressing mechanism in accordance with the present invention.

The construction of the pneumatic damper, i.e. a bound suppressing mechanism, is shown in more detail in FIG. 2, in which the pneumatic damper 100 includes a cylinder 101 which is open at one end and substantially closed at the other and, a plunger 102 slidably encased in the cylinder 101, a compression spring 103 interposed between one end of the plunger 101 and the closed end of the cylinder 101 and a holder 104 coupled to the upper front face of the rear extension 4. The cylinder 101 has a flange 101*a* at its open end and, when the holder 104 is secured to the upper front face of the rear extension 4 covering the open end of the cylinder 101, the flange 101*a* is clamped between the holder 104 and the upper front face of the rear extension 4 so that the cylinder 101 should be firmly held in position. An air vent 105 of 0.5 to 0.6 mm diameter is formed though the closed end of the cylinder 101.

The plunger 102 has an axial projection 102*a* which extends idly through a window 106 in the holder 104 and is in contact, via a cushion piece 107, with the rear end of the hammer wood 1*b* of the hammer 1. A cushion piece 108 is also attached to the front face of the plunger 102 surrounding the projection 102*a*.

A like annular cushion piece 109 is attached to the rear inner end face of the cylinder 101. A gap of only 0.03 to 0.05 mm is left between the peripheral surface of the plunger 102 and the inner wall of the cylinder 101 in order to prevent passage of air except for through the air vent 105. In order to minimize noises to be caused by reciprocation of the plunger 102 in the cylinder 101, proper lublicant may be applied to the plunger 102. As an alternative, the plunged may be coated with proper lublicative material.

The pneumatic damper 100 operates as follows. Before the hammer 1 is driven for swing motion, the hammer shank 1*a* is in contact with the hammer rail cloth 2 on the hammer rail 3 and the rear end of the hammer wood 1*b* remains in contact with the cushion piece 107 on the projection 102*a* of the plunger 102. Being pressed by the hammer wood 1*b* via the projection 102*a*, the plunger 102 is biased rearwards from the open end of the cylinder 101 against repulsion by the compression spring 103 and the cushion piece 108 on the plunger 102 is placed out of contact with the holder 104.

On key depression, the hammer 1 swings upwards towards the string (not shown) and the plunger 102 is released from pressure by the hammer shank 1*a*. The repulsion by the compression spring 103 forces the plunger 102 to move towards the open end of the cylinder 101 until the cushion piece 108 is brought into pressure contact with the holder 104.

After beating the string, the hammer 1 is pushed back towards the initial rest position by repulsion of the string and the rear end of the hammer wood 1*b* bumps against the cushion piece 107 on the projection 102*a*, thereby again biasing the plunger 102 from the open end of the cylinder 101 against repulsion of the compression spring 103. Due to this bias of the plunger 102, a part of the air in the cylinder 101 is forced out through the air vent 105. However, thanks to the small size of the air vent 105, however, fluid viscous resistance at passage of the air through the air vent 105 absorves dynamic energy of the hammer 1 in proportion to speed of the motion and significantly mitigates shock to be generated when the hammer shank 1*a* bumps against the hammer rail cloth 2. Such decelerated contact of the hammer 1 with the hammer rail cloth 2 causes no substantial bound of the hammer 1 which, as a consequence, swiftly settles to the initial rest position in a state ready for the next key depression.

Figure 3A:
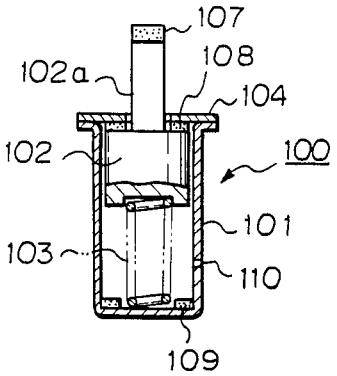
Figure 3B:
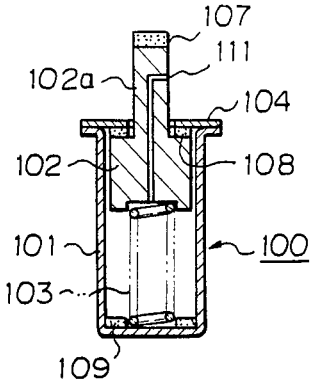
Figure 3C:
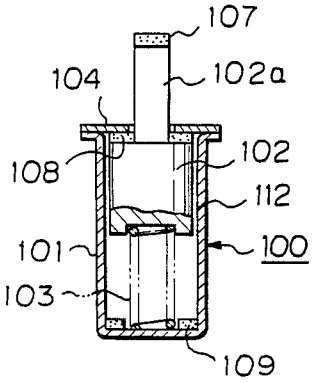

As the hammer wood 1*a* bumps against the projection 102*a* and the plunger 102 presses the compression spring 103, the latter may react to push back the plunger 102 by its own repulsion. In practive, however, small size of the air vent 105 acts to generate negative pressure within the cylinder 101 which brakes such push back by spring repulsion. The extent of pneumatic damping can be adjusted as desired by proper choice of the air vent size. Several modifications are shown in FIGS. 3A, 3B and 3C. In the embodiment shown in FIG. 3A, an air vent 110 is formed radially through the peripheral wall of the cylinder 101. In the embodiment shown in FIG. 3B, an air vent 111 is formed in the plunger, one end opening outside the cylinder 101 and the other end opening inside the cylinder 101. In the embodiment shown in FIG. 3C, the air vent takes the form of an annular gap 112 of 0.1 to 0.2 mm around the plunger 102. Due to the large size of the annular gap, air passes therethrough as the plunger 102 reciprocates in the cylinder 103 and its fluid viscous resistance absorves the dynamic energy of the hammer 1.

Figure 4:
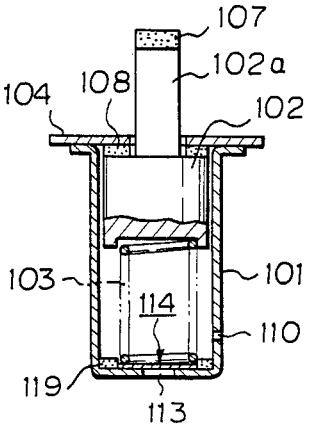
FIG. 4 is a side sectional view of the other embodiment of the bound suppressing mechanism in accordance with the present invention.
Figure 5:
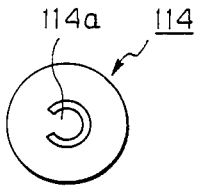
FIG. 5 is a plan view of a check valve used for the mechanism shown in FIG. 4.

The other modification of the pneumatic damper is shown in FIG. 4, in which a radial air vent 110 is formed in the cylinder 101 and another through hole 113 is formed in the closed end of the cylinder 101. The hole 113 is by far larger in diameter than the air vent 110. Usually, the diameter is in a range from 1 to 2 mm. Further a check valve 114 is attached to the closed end being surround by the cushion piece 109. As shown in FIG. 4, the check valve 114 may take the form of a circular rubber sheet as shown in FIG. 5. A C-shaped slot is formed in the rubber sheet in order to configurate a flexible tongue 114*a* which covers the hole 113 in the cylinder 101 when the check valve 114 is set in position.

On key depression, the plunger 102 is pushed back off the closed end by repulsion of the spring 103 and, due to the negative pressure caused thereby, the tongue 114*a* of the check valve 114 flexes inwards to open the hole 113. Then instant entry of outside air assists movement of the plunger 102.

As a substitute for the radial air vent 110, the air vents 111 and 112 shown in FIGS. 3B and 3C may be employed also. Further an air vent may be formed through the tongue 114*a* of the check valve 114 itself.

Figure 6:
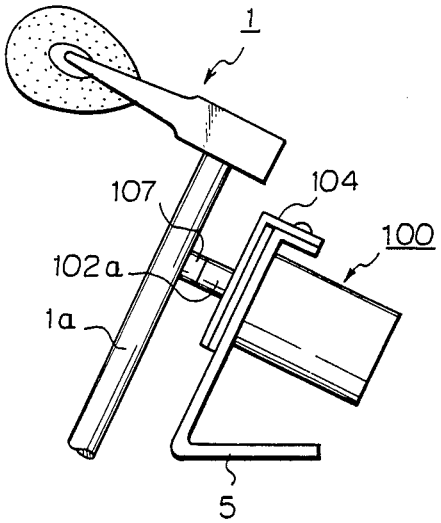
FIG. 6 is a side view of the other embodiment the bound suppressing mechanism in accordance with the present invention.

A different arrangement of the action assembly with the pneumatic damper in accordance with the present invention is shown in FIG. 6. In this case, a substantially L-shaped hammer rail 5 is used and a pneumatic damper 100 in accordance with the present invention is directly coupled to the vertical branch of the hammer rail 5 in an arrangement such that the hammer shank 1*a* of a corresponding hammer 1 rests on the axial projection 102*a* of the pneumatic damper 100 via the cushion piece 107 in its initial rest position. The hammer rail cloth 2 in FIG. 1 is removed in this arrangement. The pneumatic damper 100 may have any one of the foregoing constructions.

Since the initial rest position of the hammer 1 is fixed by position of the cushion piece 107 on the plunger 102, a somewhat stronger compression spring 103 should preferably be used. Use of such a strong spring raises damping effect by the air vent on to and from motion of the plunger 102 in the cylinder 101.

Figure 7:
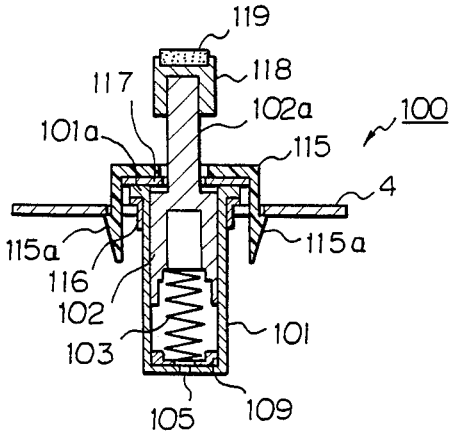
FIGS. 7 to 9 are side sectional view of various modifications of the bound suppressing mechanism in accordance with the present invention.

Another embodiment of the bound suppressing mechanism in accordance with the present invention is shown in FIG. 7 in which the mechanism again takes the form of a pneumatic damper 100. The cylinder 101 of the pneumatic damper 100 is idlly inserted into an opening in the rear extension 4 of the hammer rail 3, or the hammer rail 5 in FIG. 6, and the flange 101*a* of the cylinder 101 is clamped between a fixer lid 115 and a cushion flange 116 attached to the rear extension 4. The fixer lid 115 is made of a flexible material such as synthetic resin and provided with legs 115*a* elastically engageable with the rear extension 4. A spacer 117 is interposed between the fixer rid 115 and the flange 101*a* of the cylinder 101. A cap 118 attached to the end of the projection 102*a* carries a cushion piece 119. The cusion flange 116 is made of a flexible material such as rubber and the cusion piece 119 is made of supple leather.

Figure 8:
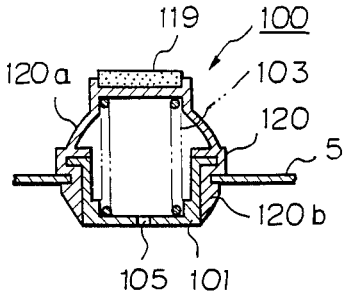

A modification of the pneumatic damper 100 is shown in FIG. 8, in which the cylinder 101 is also inserted into an opening in the hammer rail 5, or the rear extension 4 of the hammer rail 3 in FIG. 1, in combination with a cover 120 closing its open end. The cover 120 is made of a flexible material and composed of a dome section 120*a* and a cylindrical section 120*b*. The dome section 120*a* carries a cushion piece 119 and the cylindrical section 120*b* is force inserted in the gap between the hammer rail 5 and the cylinder 101 in order to fix the position of the pneumatic damper 100. The compression spring 103 is interposed between the cylinder 101 and the cover so that elastic deformation of the cover 120 functions as a sort of plunger. Reduction in number of parts well lowers the production cost.

Figure 9:
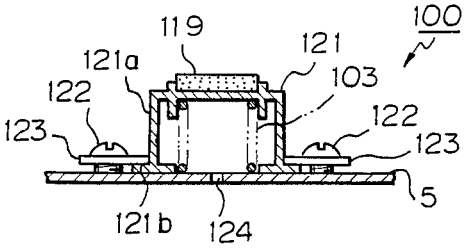

A modification shown in FIG. 9 also reduces number of parts. In this case, an air vent 124 is formed through the hammer rail 5 and a casing 121 made of a flexible material such as synthetic resin is set to the hammer rail 5 covering the air vent 124. More specifically, the casing 121 includes a cylindrical section 121*a* carrying a cushion piece 119 on the closed end and a brim section 121*b* formed at the open end of the cylindrical section 121*a*. The brim section 121*b* is pressed to the hammer rail by set screws 122 via washers 123. A compression spring 103 is arranged within the cylindrical section. Here again, elastic deformation of the cylindrical section 121*a* functions as a sort of plunger.

In the case of the constructions shown in FIGS. 8 and 9, the compression spring 103 may be omitted when the material for the cover 120 and casing 121 is highly elastic.

Figure 10:
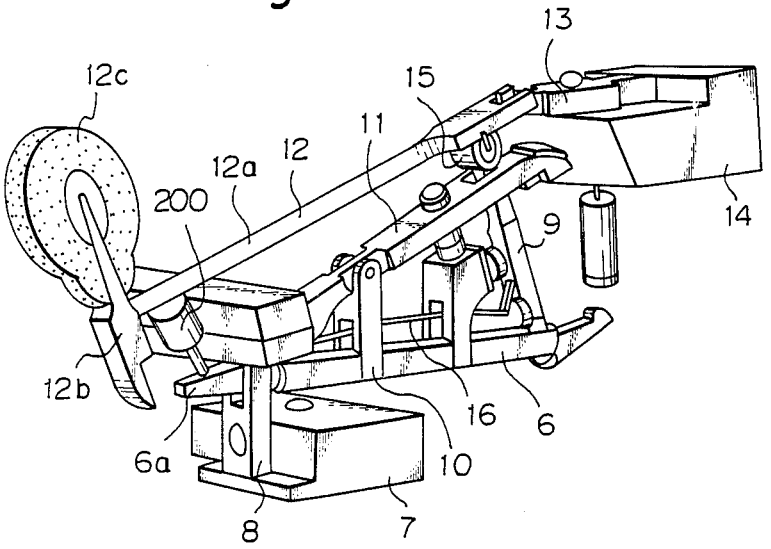
FIG. 10 is a fragmentary perspective view of an action assembly of a grand piano provided with one embodiment of the bound suppressing assembly in accordance with the present invention.

In the embodiment shown in FIG. 10, the present invention is applied to an action assembly for a grand piano. The action assembly includes a wippen 6 pivoted at the rear end to a wippen rail 7 via a wippen flange 8 and supported about the middle by a capstan (not shown) secured to the rear end of an associated key. The other end of the wippen 6 pivotally supports a jack 9. A repetition lever flange 10 secured to the wippen 5 pivotally supports a repetition lever 11 above the wippen 5. Above the repetition lever 11 is pivoted a hammer 12 to a hammer shank flange 13 on a shank flange rail 14. Near the pivot the hammer 12 is provided with a hammer roller 15 which rests on the top face of the repetition lever 11. The repetition lever 11 is accompanied with a repetition spring 16 whose repulsion pushes up the repetition lever 11 in order to register the hammer 12 at the initial rest position. The hammer 12 includes a hammer shank 12*a*, a hammer wood 12*b* and a hammer felt 12*c*. The jack 9 extends upwards through the repetition lever 11 and its top and abuts against the hammer roller 15.

On key depression, the wippen 6 swing upwards to toss the hammer 12 via the jack 9. After beating an associated string (not shown), the hammer 12 moves to resume its initial rest position due to repulsion of the string. Shock caused by this returning motion of the hammer 12 is borne by the repetition lever 11 and a hammer shank felt (not shown) mounted to the wippen 6. Since damping effect by these element is not rich enough for complete absorption, the hammer 12 tend to bound on arrival at the initial rest position thereby delaying settlement to the initial rest position. The bound suppressing mechanism in accordance with the present invention takes the form of a pneumatic damper 200 mounted to the rear extension 6*a* of the wippen 6 in contact with the hammer shank 12*a* of the hammer 12.

Figure 11:
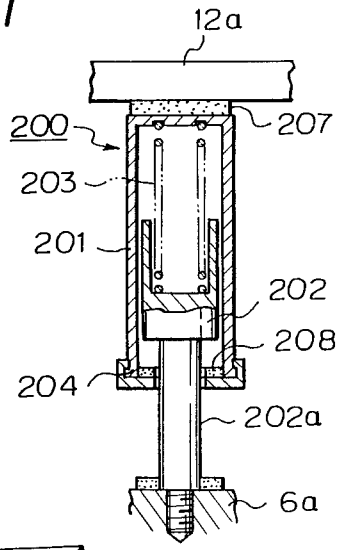
FIG. 11 is a side sectional view of the bound suppressing mechanism shown in FIG. 10.

One embodiment of such a pneumatic damper 200 is shown in FIG. 11, in which the pneumatic damper 200 includes a cylinder 201 closed at one end, a plunger 202 slidably encased within the cylinder 201 and a compression spring 203 interposed between the closed end of the cylinder 201 and the plunger 203. A cylindrical gap of 0.05 to 0.1 mm is left between the peripheral surface of the plunger 202 and the inner wall of the cylinder 201.

The open end of the cylinder 201 is closed by a lid 204 and axial projection 202*a* of the plunger 202 extends idlly through the lid 204 and its bottom end is screwed into the rear extension 6*a* of the wippen 6. Outside air is introduced into the cylinder 201 through the gap between the lid 204 and the projection 202*a* of the plunger 202. A cushion piece 207 is attached to the outer face of the closed end of the cylinder 201 and the lid 204 is internally provided with a cushion piece 208.

When the hammer 12 assumes its initial rest the hammer shank 12*a* presses the cylinder 201 downwards against repulsion of the compression spring 203. The spring constant of the compression spring 203 is chosen so that a small gap should be left between the lower end of the plunger 202 and the cushion piece 208 on the lid 204 in this state.

On key depression, the hammer 12 swings upwards and the pressure on the cylinder 201 is removed. Then, repulsion of the compression spring 203 forces the cylinder 201 to move upwards until the lower end of the plunger 202 comes into pressure contact with the cushion piece 208 on the lid 204.

After beating the associated string, the hammer 12 moves to resume its initial rest position and the hammer shank 12*a* first bumps against the cushion piece 207 on the cylinder 201 which is again forced to move downwards. During this process, in addition to repulsion by the compression spring 203, fluid viscous resistance of the air flowing the gap between the plunger 204 and the cylinder 201 brakes the motion of the cylinder 201. Although a part of the air is discharged outside the cylinder 201 through the gap between the plunger projection 202*a* and the lid 204, negative pressure caused thereby is not so large as to mar the braking action by such fluid viscous resistance of the air. As a consequence, shock by bump of the hammer shank 12*a* is almost completely absorved and no bound of the hammer 12 takes place.

Various modifications like those shown in FIGS. 3A to 3C are also employable.

Figure 12:
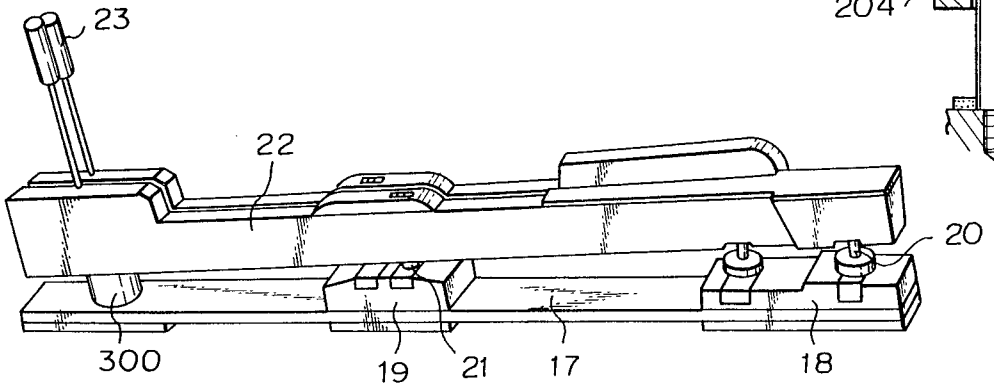
FIG. 12 is a perspective view of a key assembly of an upright piano with one embodiment of the bound suppressing mechanism in accordance with the present invention.

In the embodiment shown in FIG. 12, the present invention is applied to a key assembly for an upright piano. The key assembly includes a key frame 17 mounted on a key bed (not shown), a front rail 18 mounted to the front end of the key frame 17 and a balance rail 19 mounted to the middle of the key frame 17. Front pins 20 are mounted to the front rail 18 and balance key pins 21 are mounted to the balance rail 19. A key 22 is mounted at its middle to the balance key pins in a vertically swingable arrangement. The key 22 is in engagement at its front end with the front pins 20 in order to be blocked against horizontal swing. A capstan 23 is mounted to the rear end of the key 22 in order to bear an action assembly (not shown). The bound suppressing mechanism in accordance with the present invention takes the form of a pneumatic damper 300 mounted to the rear end of the key frame 17 whilst bearing the rear end of the key 22.

Figure 13:
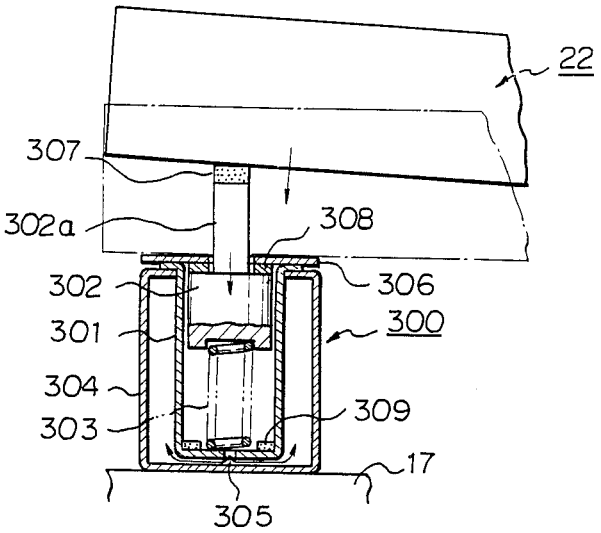
FIG. 13 is a sectional side view of the bound suppressing mechanism shown in FIG. 12.

As shown in more detail in FIG. 13, the pneumatic damper 300 a cylinder 301 encased within a casing 304 secured to the rear end of the key frame 17, a plunger 302 slidably received in the cylinder 301 and a compression spring 303 interposed between the plunger 302 and the closed end of the cylinder 302. The cylinder 301 has a flange 301*a* at its open end and an air vent 305 formed through its closed end. The plunger 302 has an axial projection 302*a* which extends outside the casing 304 and carries at its top end a cushion piece 307 for contact with the rear end of the key 22. The open end of the cylinder 301 is closed by a fixed lid 306 which presses the flange 301*a* of the cylinder 301 to the top face of the casing 304. The lid 306 is internally provided with a cushion piece 308. There is left a slight gap between the plunger projection 302*a* and the lid 306 and the cushion piece 308. A cushion piece 309 is attached to the closed end of the cylinder 301 surrounding the air vent 305.

When the key 22 assumes its initial rest position, the weight of the key 22 plus the associated action assembly presses the plunger 302 downwards against repulsion of the compression spring 303 and the rear end of the key 22 abuts against the lid 304 as shown with chain lines in the drawing.

On key depression, the rear end of the key 22 moves upwards as shown with solid lines. Due to removal of the pressure, the plunger 302 is forced to move upwards by repulsion of the compression spring 303 and the top end of the plunger 302 comes into pressure contact with the cushion piece 308 on the lid 304.

After beating an associated string (not shown), the rear end of the key 22 moves towards its initial rest position and bumps against the cushion piece 307 on the plunger projection 302*a*. As a consequence, the plunger 302 is again pressed downwards against repulsion of the compression spring 303. During this process, fluid viscous resistance of the air flowing through the gap between the plunger 302 and the cylinder 301 applies effective braking action on the motion of the plunger 302, thereby effectively alleviating the shock. As a consequence, there is no substantial bound of the key 22 at arrival at the initial rest position. Negative pressure caused by discharge of air through the air vent is again not so significant as to mar the braking action by the fluid viscous resistance.

In order to minimize shock caused by impulsive contact of the rear end of the key 22 with the lid 306, an additional cusion piece may be mounted atop the lid 306.

Modification like those shown in FIGS. 3A to 3C, FIG. 4 and FIGS. 7 to 9 are also employable.

Figure 14:
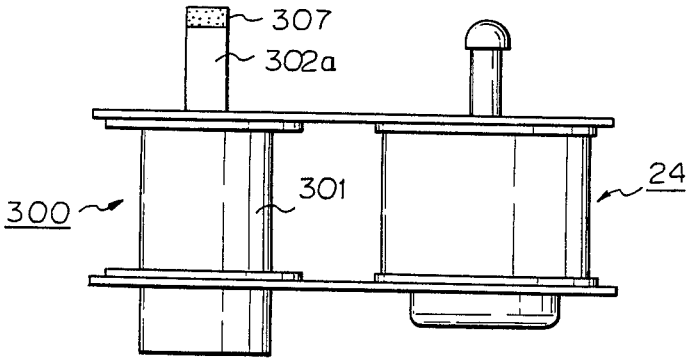
FIG. 14 is a side view of a modification of the damper 300.

In the embodiment shown in FIG. 14, the present invention is applied to a key assembly which includes a solenoid 24 arranged between the rear end of the key and the key frame. In this case, the pneumatic damper 300 is supported by upper and lower yokes 24*a* and 24*b* of the solenoid 24.

In a modification, a coil may be wound around the cylinder 301 so that the pneumatic damper 300 should operate as a sort of solenoid also. Significant reduction in number of parts is resulted.

I claim:

1. An improved mechanism for suppressing rebound of a pluraity of swingable hammers of a piano from their initial rest position after striking a piano string, said mechanism comprising a plurality of swingable hammers, a seat detached from its corresponding one of said swingable hammers, said swingable hammers having an initial rest position supported by said seat, and at least one pneumatic damper having an air vent and arranged directly supporting said seat where one of said swingable hammers assumes its initial rest position, said pneumatic damper acting under the principle of fluid viscous resistance, said damper upon being acted upon by said hammer after striking a string of said piano suppresses the tendency of said hammer from rebounding from said seat such that said hammer assumes its initial rest position upon said seat.

2. An improved mechanism as claimed in claim 1 in which said pneumatic damper includes a cylinder closed at one end, a plunger slidably encased in said cylinder and having an axial projection which abuts against said swingable element when the latter is at said initial rest position, an air vent and a spring pressing said plunger towards said swingable element.

3. An improved mechanism as claimed in claim 2 in which said air vent is formed radially through the peripheral wall of said cylinder.

4. An improved mechanism as claimed in claim 2 in which said air vent is formed axially through the closed end of said cylinder.

5. An improved mechanism as claimed in claim 2 in which said air vent is formed through said plunger and said axial projection.

6. An improved mechanism as claimed in claim 2 in which said air vent takes the form of a cylindrical gap between said plunger and said cylinder.

7. An improved mechanism as claimed in claim 1 in which said pneumatic damper includes a cylinder closed at one end, an elastic cover made up of a dome section covering the open end of said cylinder and a cylindrical section coupled to said cylinder and an air vent, the outer face of said elastic cover abutting against said swingable element when the latter is at said initial rest position.

8. An improved mechanism as claimed in claim 7 further comprising a spring interposed between the closed end of said cylinder and said dome section of said elastic cover.

9. An improved mechanism as claimed in claim 1 in which said pneumatic damper includes an elastic cylindrical casing whose open end is closed by a part of said key musical instrument, the closed end of said casing abutting against said swingable element when the latter is at said initial rest position.

10. An improved mechanism as claimed in claim 9 further comprising a spring interposed between said part of said key musical instrument and said closed end of said casing.

11. An improved mechanism as claimed in claim 1 wherein said air vent is of a predetermined diameter to cause strong fluid viscous resistance thereby mitigating bound of said swingable elements.

12. An improved mechanism as claimed in claim 8 wherein said air vent has a diameter in the range of 0.5 to 0.6 millimeters.

* * * * *

UNITED STATES PATENT AND TRADEMARK OFFICE

CERTIFICATE OF CORRECTION

PATENT NO. : 4,760,768

DATED : August 2, 1988

INVENTOR(S) : Yamamoto

It is certified that error appears in the above-identified patent and that said Letters Patent is hereby corrected as shown below:

Column 1, line 16, "absorvable" should read --absorbable--.
Column 1, line 60, "absorving" should read --absorbing--.
Column 1, line 66, "absorve" should read --absorb--.
Column 2, line 19, "mobil" should read --mobile--.
Column 2, line 66, after "embodiment" insert --of--.
Column 3, line 1, "view" should read --views--.
Column 3, line 32, before "beat" insert --to--.
Column 3, line 66, "lubicant" should read --lubricant--.
Column 3, line 67, "plunged" should read --plunger--.
Column 3, line 68, "lublicative" should read --lubricative--.
Column 4, line 28, delete "however".
Column 4, line 29, "absorves" should read --absorbs--.
Column 4, line 41, "practive" should read --practice--.
Column 4, line 57, "absorves" should read --absorbs--.
Column 4, line 66, "surround" should read --surrounded--.
Column 5, line 37, "idlly" should read --idly--.
Column 5, line 45, "rid" should read --lid--.
Column 5, line 47, "cusion" should read --cushion--.
Column 5, line 49, "cusion" should read --cushion--.
Column 6, line 21, "5" should read --6--.
Column 6, line 23, "5" should read --6--.

UNITED STATES PATENT AND TRADEMARK OFFICE

CERTIFICATE OF CORRECTION

PATENT NO. : 4,760,768

DATED : August 2, 1988

INVENTOR(S) : Yamamoto

It is certified that error appears in the above-identified patent and that said Letters Patent is hereby corrected as shown below:

Column 6, line 35, "swing" should read --swings--.
Column 6, line 42, "element" should read --elements--.
Column 6, line 43, "tend" should read --tends--.
Column 6, line 60, "idlly" should read --idly--.
Column 7, line 26, "absorved" should read --absorbed--.
Column 7, line 53, "302" should read --301--.
Column 8, line 9, "304" should read --306--.
Column 10, line 22, "8" should read --11--.

Signed and Sealed this

Eighth Day of August, 1989

*Attest:*

*Attesting Officer*

DONALD J. QUIGG

*Commissioner of Patents and Trademarks*